US007040457B1

(12) United States Patent
Bene'

(10) Patent No.: US 7,040,457 B1
(45) Date of Patent: May 9, 2006

(54) MOTOR SPEED CONTROLLER SYSTEM FOR FREIGHT ELEVATOR DOORS

(76) Inventor: Wayne J. Bene', 4409 Grey Haven, St. Louis, MO (US) 63128

( * ) Notice: Subject to any disclaimer, the term of this patent is extended or adjusted under 35 U.S.C. 154(b) by 15 days.

(21) Appl. No.: 10/289,679

(22) Filed: Nov. 7, 2002

Related U.S. Application Data

(60) Provisional application No. 60/336,943, filed on Nov. 8, 2001.

(51) Int. Cl.
*B66B 13/14* (2006.01)

(52) U.S. Cl. ..... 187/316; 318/466

(58) Field of Classification Search ..... 187/316, 187/317, 277, 296; 49/118, 120, 26–30; 318/280–286, 466–472; 160/291, 292, 293.1, 160/310, 311
See application file for complete search history.

(56) References Cited

U.S. PATENT DOCUMENTS 4,408,146 A * 10/1983 Beckerman ..... 318/264
4,776,433 A * 10/1988 Lagree et al. ..... 187/316
5,587,565 A 12/1996 Schröder-Brumloop et al. ..... 187/316
5,859,395 A * 1/1999 Fargo ..... 187/316
5,929,580 A * 7/1999 Mullet et al. ..... 318/466
6,002,217 A * 12/1999 Stevens et al. ..... 318/9
6,078,249 A * 6/2000 Slavik et al. ..... 338/180
6,161,438 A * 12/2000 Mullet et al. ..... 73/774
6,177,771 B1 * 1/2001 Kinzer et al. ..... 318/280
6,194,851 B1 * 2/2001 Denault et al. ..... 318/139
6,456,916 B1 * 9/2002 Edgar et al. ..... 701/49
2004/0032232 A1 * 2/2004 Murray et al. ..... 318/434

FOREIGN PATENT DOCUMENTS

JP 2004019200 A * 1/2004

OTHER PUBLICATIONS

UniMeasure.com 1996.*

* cited by examiner

*Primary Examiner*—Jonathan Salata
(74) *Attorney, Agent, or Firm*—Thompson Coburn, LLP

(57) ABSTRACT

A linear displacement potentiometer is mechanically tied to an elevator door/gate and provides a voltage corresponding to the door/gate position to a programmable controller. The programmable controller uses a software program to determine when the door/gate is fully open or fully closed. The program controls a variable speed motor drive to accelerate/decelerate the door/gate. When the linear displacement potentiometer determines the door/gate is at a predetermined location, the motor speed is reduced to a fixed value. When the door/gate position is nearly open/closed, the motor speed is decelerated to zero speed.

15 Claims, 7 Drawing Sheets

MOTOR SPEED CONTROLLER SYSTEM FOR FREIGHT ELEVATOR DOORS

This application claims priority from provisional application Ser. No. 60/336,943, filed Nov. 8, 2001.

BACKGROUND OF THE INVENTION

1. Field of the Invention

The present invention relates to an apparatus and method for elevator door/gate control.

2. Brief Description of the Prior Art

Elevator doors are used in passenger elevators and in freight elevators. Passenger elevator doors open horizontally and are lighter in weight than freight elevator doors. A typical passenger elevator door will weigh approximately one hundred pounds compared to freight elevator doors that typically weigh about one thousand pounds. Passenger elevator doors are driven with a cable attached to a sprocket, whereas freight elevator doors are operated with a leaf chain over an H-sheave. Leaf chains are required for freight elevator doors because they can bear greater loads than sprocket driven chains or belts.

A sprocket driven chain or belt such as used with passenger elevator doors provides a direct correlation between the rotation of the sprocket and the linear displacement of the elevator door. A leaf chain, however, slips on the sheave and provides no definite relationship between the rotation of the sheave and linear displacement of the elevator door.

Freight elevators typically include an elevator door and a gate panel. The elevator door functions independently of the gate panel. Conventional freight elevator door/gate control systems are primarily mechanical in nature. The opening and closing of the freight elevator door is controlled with mechanical limit switches. The mechanical limit switches control a motor for opening and closing the door depending upon the path position of the freight elevator door. Typically, freight elevator doors are slowed down as they approach their mechanical limits of fully-open or fully closed. For example, the doors may be run at full speed until the doors physically contact the limit switch, whereupon a direct current is then applied to the motor to assist in braking the elevator door speed. When a two-speed motor is combined with a limit switch, the doors are run at full speed until the limit switch is triggered, then the motor is reduced to half-speed. When the doors are being opened, the doors stop when they hit a mechanical sill. When the doors are being closed, they stop when they slam together. The doors cannot be reduced to zero speed as they are carried by momentum after they trip the limit switch. Limit switches must be periodically repositioned because friction between the elevator doors and track increases with time causing the doors to open and close improperly.

A freight elevator gate panel typically includes a rotary limit switch connected to a roller chain driven by a sprocket. The chain is connected to a gate. The gate position of fully open and fully closed is controlled by the limit switch.

U.S. Pat. No. 5,587,565 describes a passenger elevator door controller that receives pulses generated by an incremental encoder based on the rotation of the chain or belt sprocket drive shaft whenever the passenger elevator door is in motion. During initialization of the system, the controller is taught the number of pulses for travel in each direction. If the doors are set in motion and the power goes off, the encoder will stop counting but the doors will continue drift before they come to a stop. The controller therefore loses track of door position even if there is a battery backup. The system is also susceptible to external electrical noise interfering with the count such as from fluorescent lights and electrical machinery. Because the door position is not monitored in real-time, no adjustments can be made while in motion. Another drawback is the encoder will not update its pulse count if the door is manually moved. Therefore, when the door opens or closes, it will travel the full number of pulses programmed and cause damage to the door.

BRIEF SUMMARY OF THE INVENTION

It is an object of the present invention to provide an improved apparatus and method for elevator door/gate control. Other objects and features of the invention will be in part apparent and in part pointed out hereinafter.

In accordance with the invention, an improved apparatus and method for elevator door/gate control includes a programmable logic controller connected to a linear displacement measuring sensor. In one embodiment a string potentiometer and in another embodiment a rotary potentiometer is utilized. Information regarding the position of the door/gate is supplied to the programmable logic controller by displacement of the measuring sensor, which provides an electrical output correlated to the position of the door/gate. By continuously monitoring the position of the elevator door and the gate panel, the speed of the door and the gate can be better controlled to prevent the doors from slamming into their physical limits. Product integrity and longevity is achieved while providing consistent, quiet, and smooth operation. Product fatigue is minimized through smooth starts and stops. Greater safety is achieved by reducing the speed of the door and the gate panel at their physical limits, where most physical injury occurs.

DETAILED DESCRIPTION OF THE INVENTION

Figure 1:
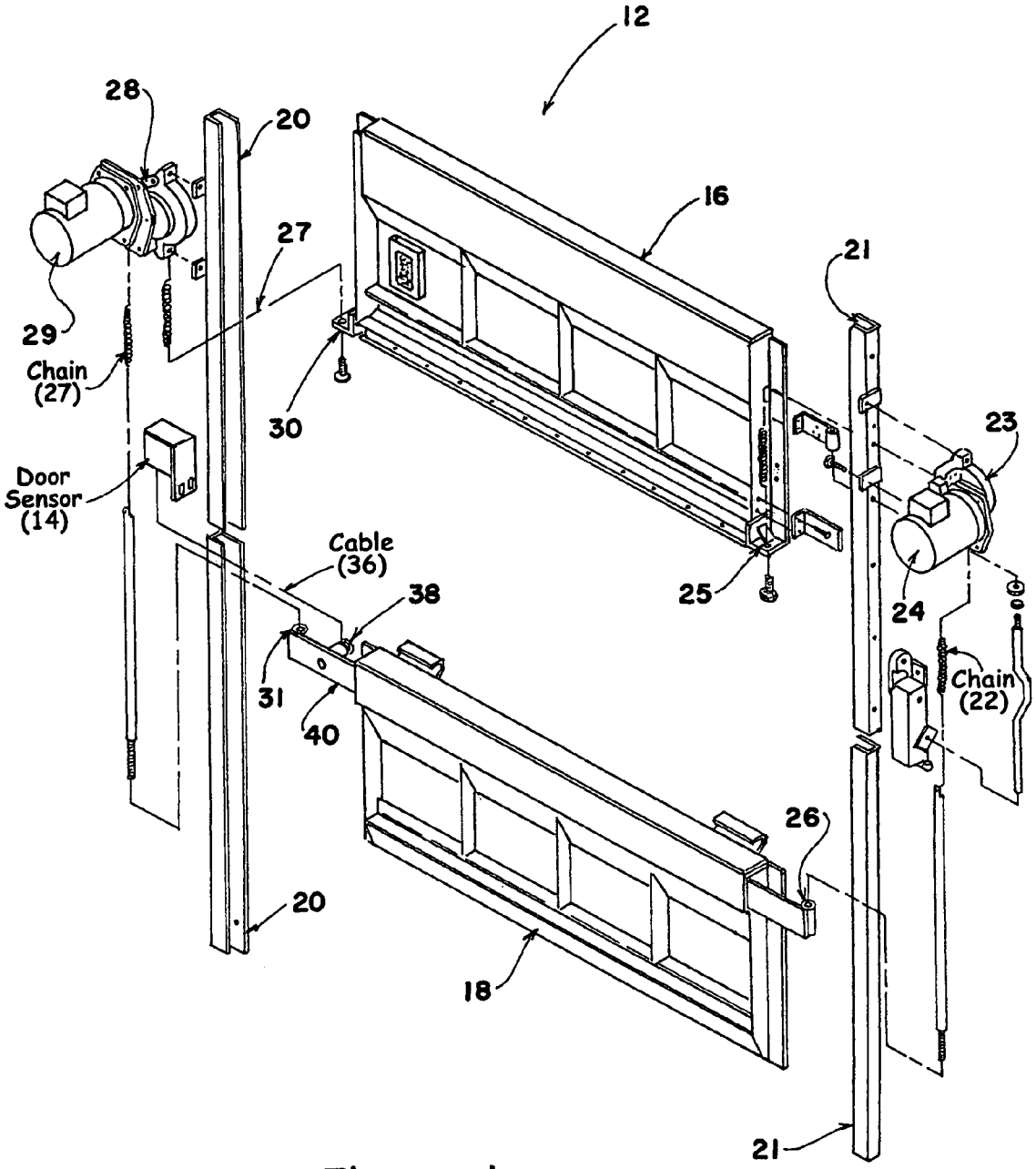
FIG. 1 is an exploded, perspective view of a pair of fright elevator doors including a string potentiometer.

FIG. 1 is a view of an elevator freight door assembly 12 having a linear displacement measuring sensor 14. In the exemplary embodiment, freight door assembly 12 includes an upper door panel 16 and a lower door panel 18. In this embodiment, upper door panel 16 moves upward and lower door panel 18 moves downward when the freight elevator doors are fully open; however, a variety of door types can be utilized. In an alternative embodiment, a single-section door, which moves upward to be fully open, can be utilized. In a further alternative embodiment, a single-section door that moves downward to be fully open can be utilized. In a still further embodiment, either upper or lower doors or both may be multi-sectioned. Freight elevator doors can be large and each door may weigh upward to 2000 pounds or more.

Linear displacement measuring sensor 14 is a potentiometer. As known in the art, potentiometers are variable resistors that convert a change in resistance to a corresponding change in voltage. A coil, within the potentiometer, tightens or relaxes and, depending upon the position of the coil, a particular resistance is measured. This resistance corresponds to a specific analog voltage. Potentiometers can be utilized to measure linear displacement or rotary displacement. When measuring linear displacement, a string potentiometer can be utilized.

In an exemplary embodiment, linear displacement measuring sensor 14 is a string potentiometer, part number 04-1172-0001MDL631941-A manufactured by Celesco Transducer Products, Inc., Chatsworth, Calif. 91311. The string potentiometer measures changes in resistance and transmits a voltage. In an alternative embodiment, a linear variable differential transformer (LVDT) may be utilized. In another alternative embodiment, a rotational variable differential transformer (RVDT) may be utilized. In a still further embodiment, polymer thick film technology may be utilized. In yet another embodiment, displacement measuring sensor 14 measures changes in amperage.

When upper door panel 16 and lower door panel 18 are equal in weight, they serve to counterbalance one another. Both upper door panel 16 and lower door panel 18 travel in coordinated opposition between two tracks 20 and 21. Dual drives are provided: A first leaf chain 22, that rotates about an H-sheave 23 and is driven by an electric motor 24, is connected at a first end 25 to a first side of upper door panel 16 and at a second end 26 to lower door panel 18. A second leaf chain 27, that rotates about an H-sheave 28 and is driven by an electric motor 29, is connected at a first end 30 to a second side of upper door panel 16 and at a second end 31 to lower door panel 18. In an exemplary embodiment, leaf chain 22 and leaf chain 27 are known in the art as "3×2" leaf chains.

Linear displacement measuring sensor 14 can be attached to either upper door panel 16 or lower door panel 18. In the exemplary embodiment shown in FIG. 1, displacement measuring sensor 14 is attached to lower door panel 18. Over a period of time leaf chains 22 and 27 will stretch from the weight of the door panels and upper door panel 16 will drop a distance from the top when the doors are fully open. Lower door panel 18 will be prevented from dropping because it is structurally supported by the sill of the door frame.

Figure 2:
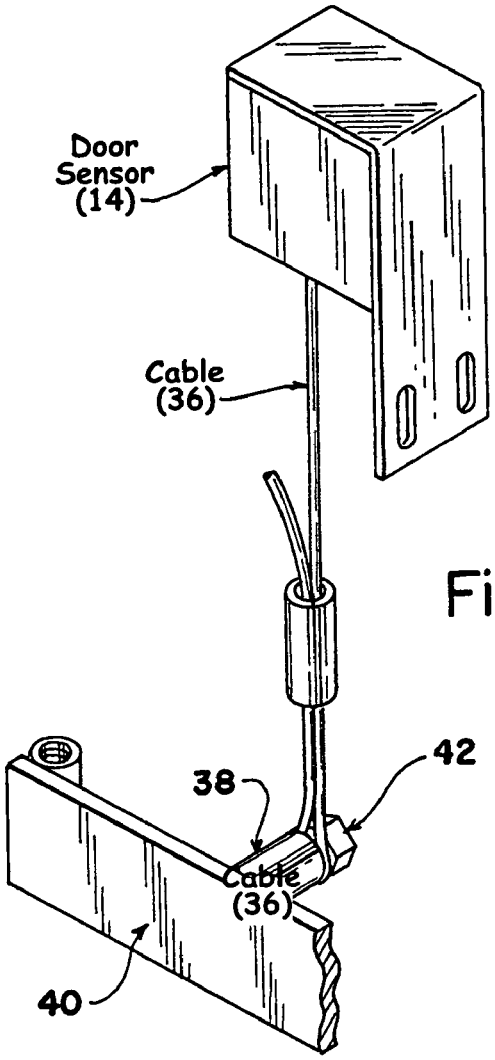
FIG. 2 is a side view of the string potentiometer connected to the elevator door shown in FIG. 1.
Figure 3:
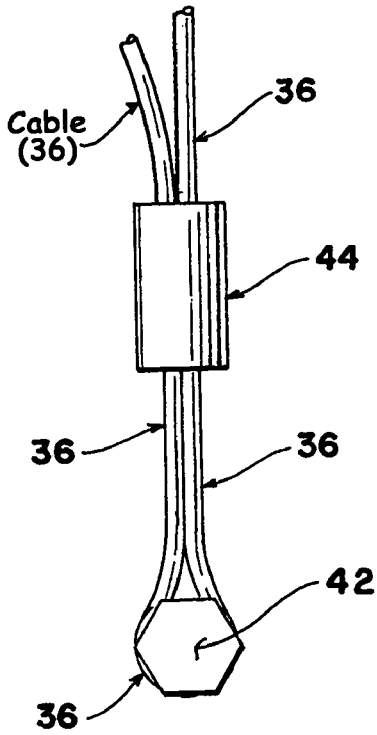
FIG. 3 is a front view of the string potentiometer shown in FIG. 2 connected to the elevator door.

As illustrated in FIGS. 2 and 3, displacement measuring sensor 14 is welded to a bracket by which it is mounted to track 20 (shown in FIG. 1). Displacement measuring sensor 14 includes a cable 36 that is attached to a standoff 38 that is connected to a door arm 40, which is connected to lower door panel 18. A desirable length for standoff 38 is 1–4 inches. In an alternative embodiment, a ¼ inch screw mounted flush against door arm 40 is utilized. Cable 36 is looped around a nut 42 which is threaded on standoff 38 and then threaded back through a crimp 44. Standoff 38 saves cable 36 from wear and tear by maintaining it a predetermined distance away from the movement of lower door panel 18 (shown in FIG. 1). As door panel 18 moves, cable 36 extends or retracts. An internal spring (not shown) in string potentiometer 14 maintains tension on cable 36 and produces an electrical output proportional to the cable travel.

Figure 4:
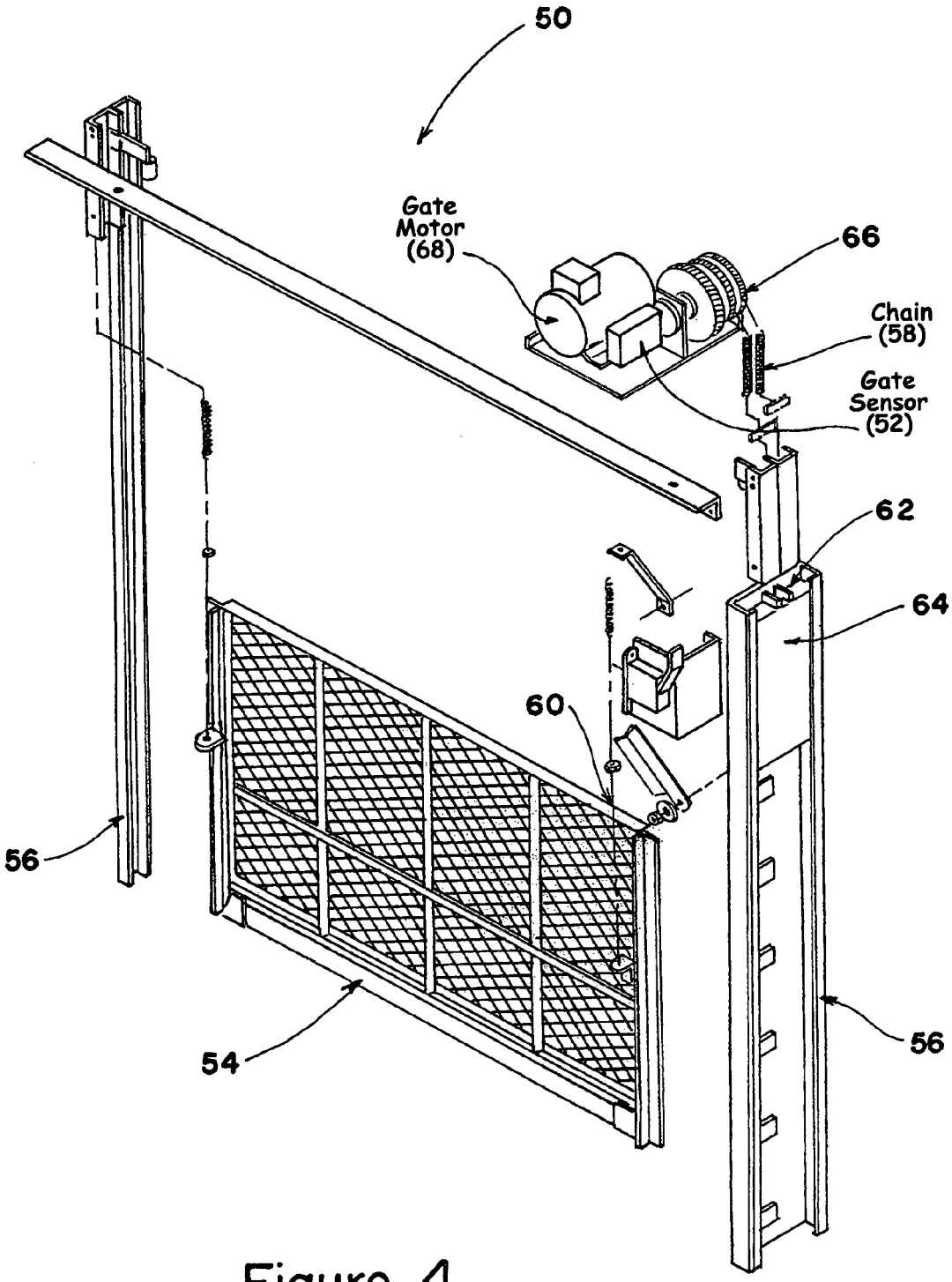
FIG. 4 is an exploded, perspective view of a gate panel assembly including a rotary potentiometer.

FIG. 4 is a schematic view of a gate panel assembly 50 including a rotary potentiometer 52. In an exemplary embodiment, rotary potentiometer 52 is part number MW 22B-10 500 manufactured by ETI Systems, Inc., Carlsbad, Calif. 92009. Gate panel assembly 50 includes a gate 54 that travels between a pair of tracks 56. A roller chain 58 is connected at a first end 60 to gate 54 and at a second end 62 to a counter weight 64. Roller chain 58 travels over a sprocket 66 that is connected to a drive shaft (not shown), which is connected to rotary potentiometer 52. The drive shaft is driven by an electric motor 68.

When gate 54 travels upward to fully open, counterweight 64 travels downward. The location of gate 54 is determined by rotary potentiometer 52. As gate 54 travels upward or downward, roller chain 58 travels along sprocket 66 and rotary potentiometer 52 rotates a particular number of turns that corresponds to the distance gate 54 has traveled. In an exemplary embodiment, rotary potentiometer is a 10 turn, 500 Ohm potentiometer. In another embodiment, a multi-turn rotary potentiometer with a desirable resistance ranging from 100 Ohms to 100K Ohms and a desirable range of three to five turns is utilized. In a further embodiment, a wire-wound single turn rotary potentiometer with a desirable resistance ranging from 500 Ohms to 20K Ohms can be utilized with a sprocket geared for the potentiometers single turn. The number of rotations and the direction of rotation, will tighten or relax a coil (not shown) within potentiometer 52. Depending upon the position of the coil, a particular resistance will be measured. This resistance will correspond to a specific analog voltage associated with the position of gate 54. Compared to leaf chains 22 and 27 (shown in FIG. 1), roller chain 58 does not stretch or slip on sprocket 66 and precisely maintains gate 54 in a particular location without lag.

Figure 5:
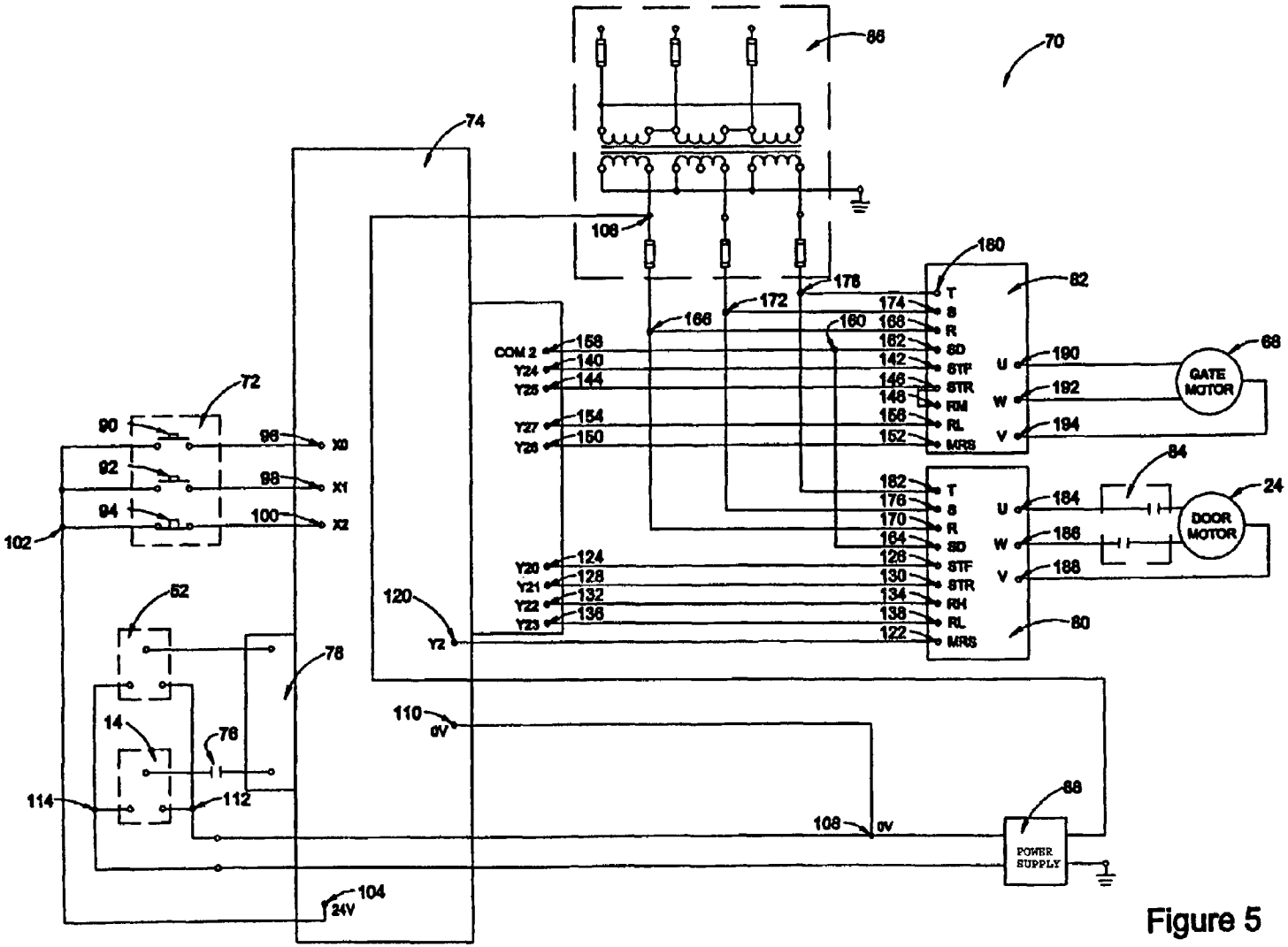
FIG. 5 is an electrical wiring diagram of a programmable logic controller circuit to control operation of the freight elevator door shown in FIG. 1 and gate shown in FIG. 4.

FIG. 5 is an exemplary embodiment of an electrical wiring diagram of programmable logic controller circuit 70 to control the opening and closing of upper and lower door panels 16 and 18 (shown in FIG. 1) and gate 54 (shown in FIG. 4). Circuit 70 includes switches 72 connected to a programmable logic controller (PLC) 74. Circuit 70 further includes door string potentiometer 14 connected to a zone relay 76. Zone relay 76 is connected to an analog-to-digital (A/D) converter 78. Circuit 70 also includes gate rotary potentiometer 52 connected to A/D converter 78. A/D converter 78 is connected to PLC 74. PLC 74 is connected to a door alternating current (A/C) variable frequency drive (VFD) 80 and to a gate A/C VFD 82. Door VFD 80 is connected to zone relay 84, which is connected to door motor 24. Gate VFD 82 is connected to gate motor 68. Power supply 86 converts 480V/3PH/60Cy power to 240VAC/120VAC. Power from power supply 86 is supplied to power supply 88 which supplies 12 VDC to string potentiometer 14 and rotary potentiometer 52.

Switches 72 includes an open switch 90, a close switch 92, and a stop/reset switch 94. Open switch 90 is connected to PLC X0 input 96. Close switch 92 is connected to PLC X1 input 98. Stop/reset switch 94 is connected to PLC X2 input 100. Switches 90, 92, and 94 are connected together at node 102, which is connected to PLC 24V electrical power 104.

Power supply 86 is connected to node 106, which supplies 4240V/3PH/60Cy power to power supply 88. Power supply 88 is further connected to node 108. Node 108 is connected to PLC 0V 110. Node 108 is further connected to node 112, which connects to door string potentiometer 14 and gate potentiometer 52. Power supply 88 is further connected to node 114, which is connected to door string potentiometer 14 and gate potentiometer 52. Power supply 86 provides 240 volts at 60 Hz to power supply 88. Power supply 88 provides door string potentiometer 14 and gate rotary potentiometer 52 a 12-volt and a zero volt signal.

PLC 74 includes a plurality of outputs Y2, Y20 through Y27. PLC 74 outputs Y2, Y20, Y21, Y22 and Y23 are connected to door VFD 80. Output Y2 120 is connected to MRS 122. Output Y20 124 is connected to STF 126. Output Y21 128 is connected to STR 130. Output Y22 132 is connected to RH 134. Output Y23 136 is connected to RL 138.

PLC 74 outputs Y24, Y25, Y26, Y27 and COM2 are connected to gate VFD 82. Output Y24 140 is connected to STF 142. Output Y25 144 is connected to STR 146, which is connected to RM 148. Output Y26 150 is connected to MRS 152. Output Y27 154 is connected to RL 156. Output COM2 158 is connected to node 160. Node 160 is connected to SD 162. Node 160 is further connected to door VFD 80 SD 164.

240V/3PH/60Cy power supply 86 is connected to door VFD 80 and gate VFD 82. Power supply 86 is connected to node 166, which is connected to R 168 and R 170. Power supply 86 is also connected to node 172 that is connected to S 174 and S 176. In addition, power supply 86 is connected to node 178 that is connected to T 180 and T 182.

Door VFD 80 has three outputs U, W, and V. Output U 184 and output W 186 connect to zone relay 84, which connects to door motor 24. Output V 188 connects to door motor 24. Gate VFD 82 has output U 190, output W 192, and output V 194 connected to gate motor 68.

Programmable logic controller circuit 70 functions to control the movement of upper and lower door panels 16 and 18 (shown in FIG. 1) and gate 54 (shown in FIG. 4). In an exemplary embodiment, string potentiometer 14 includes cable 36 (shown in FIG. 1) that is attached to door arm 40 (best seen in FIGS. 2–3) of lower door 18. In an alternative embodiment, string potentiometer 14 is attached to upper door panel 16. As lower door 18 moves up and down within tracks 20 and 21, cable 36 is extended and retracted. Upper and lower doors 16 and 18, respectively, move in coordinated opposition because they are connected together by leaf chains 22 and 27 (shown in FIG. 1). Therefore, the distance cable 36 is extended from string potentiometer 14 corresponds to a position of both upper door 16 and lower door 18.

Because string potentiometer 14 reads a change in resistance based on the extension of cable 36, the elevator door's position is tracked in real-time. If either upper door panel 16 or lower door panel 18 are manually moved, cable 36 will be extended or retracted. Unlike an encoder, if electrical power is lost, the door's position will not be lost when electrical power is regained. Instead, string potentiometer 14 will provide a resistance based on the position of cable 36 that corresponds to lower door panel 18's position. With an encoder, an electrical spike can erase a value stored within the controller but with a string potentiometer the real-time measurement is not dependent on stored values.

Similarly, the location of gate 54 is determined by rotary potentiometer 52. As gate 54 travels upward or downward, roller chain 58 travels along sprocket 66 and rotary potentiometer 52 rotates a particular number of turns that corresponds to the distance gate 54 has traveled.

Linear displacement sensor 14 tracks the upper and lower doors' position in real-time. This ensures that the elevator doors do not overshoot their mechanical limits when fully-opening or fully-closing and slam into the sill or each other. This reduces wear and tear on high-maintenance parts and ambient noise.

In the exemplary embodiment, a string potentiometer is used with a leaf-chain and H-sheave assembly for the freight elevator doors, and a rotary potentiometer is utilized with a roller cable and sprocket assembly for the elevator gate. It will be understood that a roller chain and sprocket combination may be used on the freight door system if the chain is capable of supporting the doors. In this embodiment, a rotary potentiometer may be utilized to determine the distance the freight door travels. In another alternative embodiment, a leaf chain and H-sheave combination may be used on an elevator gate. In this embodiment, a string potentiometer is utilized to determine the distance the gate travels.

Figure 6:
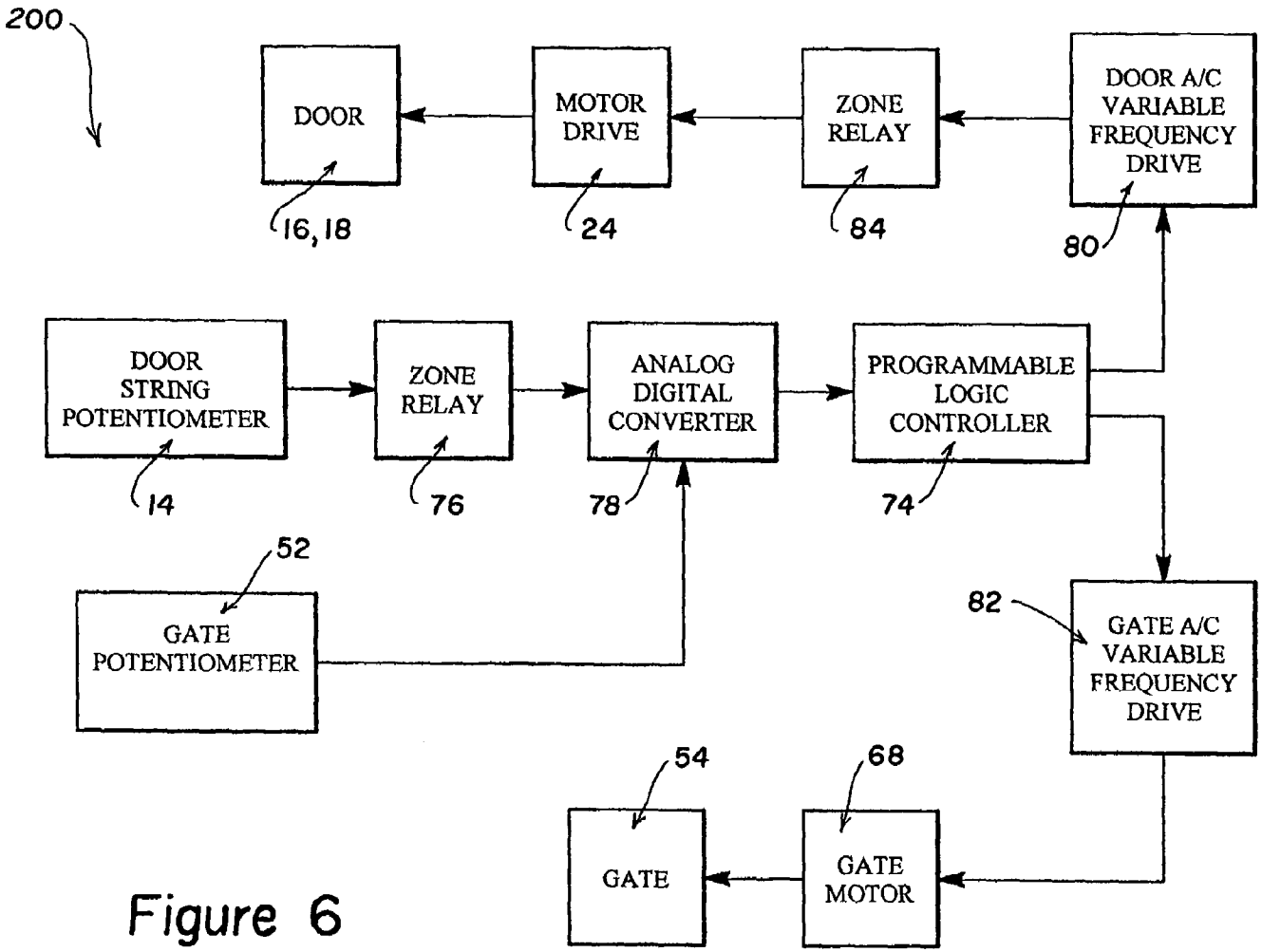
FIG. 6 is a block diagram of the control circuit shown in FIG. 5.

FIG. 6 is a block diagram of a control circuit 70 that is shown in FIG. 5. Control circuit 70 is utilized to control the movement of upper and lower door panels 16 and 18 (shown in FIG. 1) and gate 54 (shown in FIG. 4). In order to control the movement of door panels 16 and 18, A/D converter 78 converts an analog voltage generated by string potentiometer 14. Similarly, as gate 54 changes position, gate rotary potentiometer 52 generates a voltage based on the location of gate 54. In an exemplary embodiment, A/D 78 is part number Fx1N-2AD-BD manufactured by Mitsubishi, Marunouchi, Tokyo, Japan 100-8310. A/D 78 takes the analog voltage between 0–12 volts and converts the signal to a string of digital "1's" and "0's." The combination of "1's" and "0's" are used by a programmable logic controller (PLC) 74 to determine the location of door panels 16, 18 and gate 54. In an exemplary embodiment, PLC 74 is part number Fx1N-24MR-ES/UL manufactured by Mitsubishi, Marunouchi, Tokyo, Japan 100-8310. Based on the location of door panels 16, 18 and gate 54, software in PLC 74 determines whether to accelerate or decelerate door panels 16, 18 and gate 54. PLC 74 then commands door VFD 80 to accelerate or decelerate motor drive 24.

In the exemplary embodiment, string potentiometer 14 is a ten-turn potentiometer that achieves an accuracy of 333 pulses per volt in programmable logic controller 70. This allows a 14-foot door to be controlled to an accuracy of 1/28 inch. A second voltage ouput from rotary potentiometer 52 is converted by A/D converter 78 and utilized by PLC 74 to command gate VFD 82 to accelerate or decelerate gate motor 68.

In an exemplary embodiment, door VFD 80 and gate VFD 82 are part number FR-E520-0.75K-NA manufactured by Mitsubishi, Marunouchi, Tokyo, Japan 100-8310. In an alternative embodiment, adjustable speed motor drives are utilized. Most motors turn at nearly constant speed. Control of a motor's output speed can be achieved electronically by an adjustable speed drive (ASD) or mechanically via a mechanical coupling using clutches and pulleys. However, using mechanical coupling, the speed can only be varied in discrete steps. An ASD varies the motor's shaft speed to a driven load. There are three types of ASDs: voltage controlled, frequency controlled and slip energy recovery systems. Frequency controlled ASDs, also called variable frequency drive (VFD) or variable speed drive, vary alternating current motor speed in proportion to the VFD's output frequency. A VFD includes an electronic power converter that converts constant frequency alternating current power input into a variable frequency output. As the frequency of the VFD output increases, the motor speed increases.

Advantages of utilizing a VFD are that it provides greater efficiency for motor speed control than mechanical coupling, decreases maintenance downtime and repair costs because mechanical devices are eliminated, and a VFD is suitable for dirty environmental conditions. Therefore, in one embodiment an adjustable speed motor drive is utilized. In another embodiment, a variable frequency motor drive is utilized.

Since the variable frequency drive is controlled by the programmable logic controller, the output control of the motors can be selectively changed depending on the type of operation that is initiated. For instance, if the door is closing and a safety switch is tripped indicating that there is an obstruction in its path, the controller tells the drives to instantly reverse the doors without delay to prevent any possibility of injury. On the other hand, if an operator decides to stop closing the door because he needs to return to the floor, the door is decelerated and accelerated to full open speed.

In a multi-story building, a freight elevator will travel between a number of floors, and the elevator will only be located on one floor at a particular time. A signal from the elevator controller (not shown) or an elevator position switch (not shown), located in the elevator shaft, will signal a relay, called a zone relay, to close when the elevator arrives. Each floor will have its own set of zone relays. In the exemplary embodiment, zone relays 76, 84 are utilized to determine which floor the elevator is located so only those door panels and gate are operated. In one embodiment, zone relay 76 is connected to door string potentiometer 14. In an alternative embodiment, zone relay 76 is connected to gate potentiometer 52. In the exemplary embodiment, when zone relay 76 is closed it will transfer a signal from door string potentiometer 14 to A/D 78 to be forwarded to PLC 74. When PLC 74 has determined the location of upper door panel 16 and lower door panel 18, a signal will be sent to door VFD 80 to accelerate or decelerate upper door 16 and lower door 18.

Elevator doors require changes in speed during operation. Initially a door is run at full speed to accelerate the door until the door has traveled to a predetermined limit when the door is decelerated. The door then travels at a reduced speed until it reaches its near-fully-open or near-fully-closed position. A graph of the speed and time a door takes to reach its final destination are called door profiles. When a freight elevator door system is installed in the field, the elevator doors are cycled a number of times to maximize door and gate operation.

Figure 7:
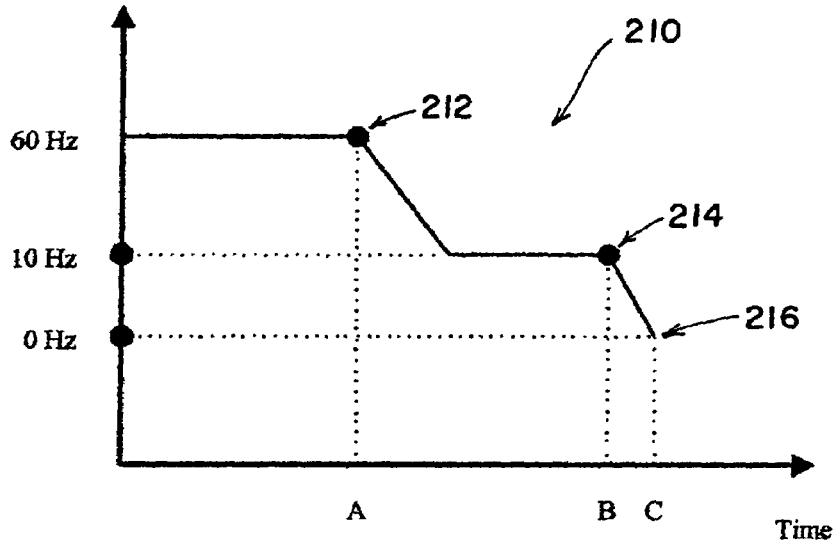
FIG. 7 is a graph of a door profile for a freight elevator door generated by the programmable logic controller shown in FIG. 5.

FIG. 7 is a graph of a door profile 210 for a freight elevator door generated by the programmable logic controller. The speed of the doors is graphed in Hertz because in the exemplary embodiment, door VFD 80 (shown in FIG. 5) is used to accelerate/decelerate door panels 16, 18 (shown in FIG. 1). In an exemplary embodiment, door panels 16, 18 are initially run at 60 Hz until they reach a predetermined location A 212. A 212 corresponds to a factory set predetermined slow down time. When string potentiometer 14 (shown in FIG. 1) determines door panels 16, 18 have reached A 212, door VFD 80 (shown in FIG. 5) reduces motor drive 24 (shown in FIG. 5) speed to 10 Hz. Door panels 16, 18 continue to travel at 10 Hz until they reach B 214. B 214 corresponds to when door panels 16, 18 are at a near full open/close position. When door panels 16, 18 reach B 214, door VFD 80 linearly decelerates motor drive 24 speed to zero speed until door panels 16, 18 are at a full stop at C 216.

Figure 8:
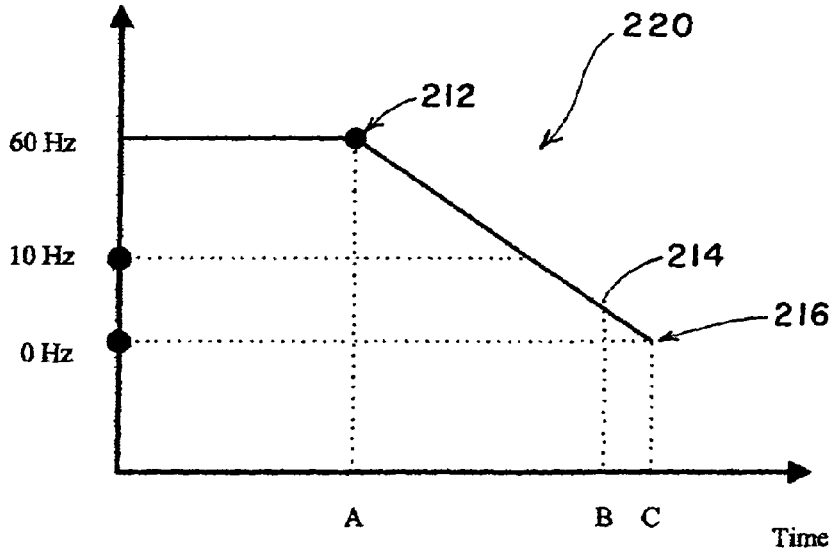
FIG. 8 is a graph of an alternate door profile for a freight elevator door generated by the programmable logic controller shown in FIG. 5.

FIG. 8 is a graph of an alternate door profile 220 for a freight elevator door generated by the programmable logic controller. Once door panels 16, 18 (shown in FIG. 1) reach point A 212, door VFD 80 (shown in FIG. 5) reduces motor drive 24 (shown in FIG. 1) speed linearly until door panels 16, 18 reach their full closed position, C 216. There is no need to have a period of time that the doors travel at a reduced speed prior to decelerating the doors to zero speed. However because of the weight of door panels 16, 18, the momentum generated by their mass, and motor operation, the door speed must be reduced for a given period prior to decelerating to a full stop.

Figure 9:
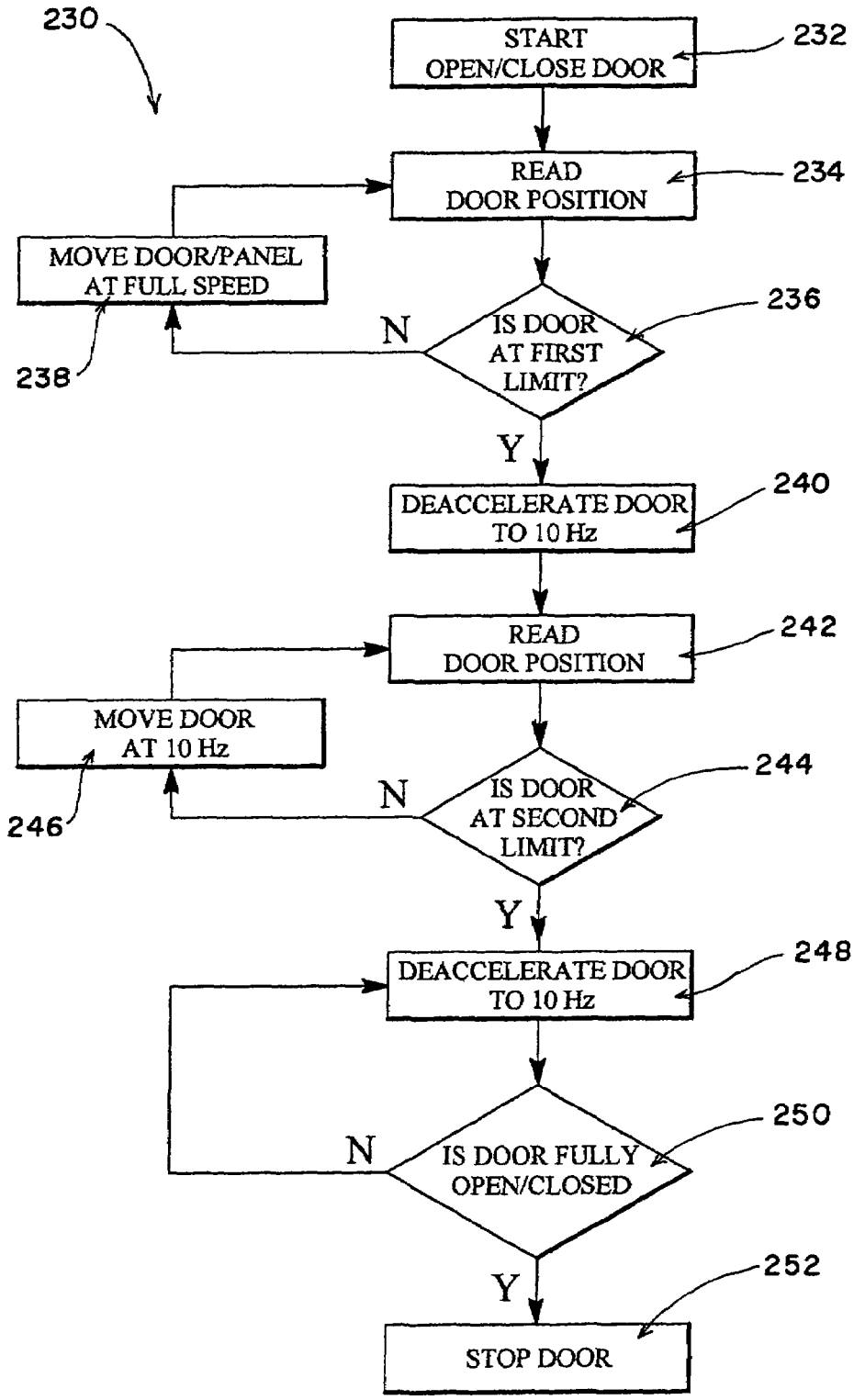
FIG. 9 is a flow chart illustrating a sequence of steps executed by the programmable logic controller during operation of freight elevator doors and gate panel.

FIG. 9 is a flow chart 230 illustrating a sequence of steps executed in an exemplary embodiment by programmable logic controller 74 (shown in FIG. 5) during operation of upper and lower door panels 16 and 18 (shown in FIG. 1) and gate 54 (shown in FIG. 5). In an alternative embodiment, the steps are executed in a microprocessor. In another alternative embodiment, the steps are executed in a microcontroller. In a still further alternative embodiment, the steps are executed in a digital signal processor.

Prior to operating upper and lower door panels 16 and 18, the elevator must be located on the floor and zone relay 76 (shown in FIG. 5) must be closed. The sequence to operate upper and lower door panels 16 and 18 respectively (shown in FIG. 1) starts 232 when an operator depresses either open switch 90 (shown in FIG. 5) or close switch 92 (shown in FIG. 5). Door string potentiometer 14 determines 234 the position of lower door panel 18 and generates an analog voltage corresponding to the door position. This analog voltage is converted to a digital signal by A/D converter 78 and PLC 74 compares the digital value to a preprogrammed value stored in a register. The preprogrammed valued corresponds to a first limit 236. If lower door panel 18 has not reached first limit 236, it continues to move at full speed 238. When first limit 236 is reached, door VFD 80 (shown in FIG. 5) decelerates motor drive 24 (shown in FIG. 5) to reduce 240 the speed of door panels 16 and 18 to 10 Hz. String potentiometer 14 continues to read 242 the location of door panel 18. PLC 74 compares the location of door panel 18 to the second limit 244 that corresponds to the near full open/close position. If second limit 244 has not been reached, lower door panel 18 is moved 246 at 10 Hz. When string potentiometer 14 senses that lower door panel 18 has reached second limit 244, PLC 74 commands variable frequency motor drive to decelerate 248 lower door panel 18 to zero Hz. String potentiometer 14 continues to monitor the location of lower door panel 18 to determine if it is at the fully open/closed position 250. Once fully open or closed, door panels 16 and 18 are stopped 252.

The software continually monitors the time it takes the freight elevator doors to travel from the first limit 212 (shown in FIG. 7) to the near fully open/closed position 214 (shown in FIG. 7). Empirically it has been found that if the time is greater than 0.7 seconds, the door was traveling at a 10 Hz rate for too long a time. The door will be accelerated on the next cycle. However, if the time is less than 0.5 seconds, the door will be decelerated on the next cycle. This automatic monitoring is performed for each cycle of door operation. It will be understood that the pre-set times depend upon the weight of the doors, etc.

The apparatus and method for elevator door/gate control have many advantages, including, but not limited to:

Sensor values can be monitored during deceleration against time. If the door is not slowing fast enough or is slowing too fast, the speeds can be changed to provide a consistent smooth deceleration of the door, thus minimizing stress to the mechanical parts, and unwanted erratic operation of the door and slamming into mechanical limits.

Values may be stored in Electrically Erasable Programmable Read Only Memory (EEPROM) data registers that can be retained during power outages. Loss of position or mechanical limits is prevented.

Cycle time is minimized due to the complete operation to the mechanical limit. Previous controllers go through an initial braking process, stop the door, and restart under reduced power. This operation adds 1 to 2 seconds at each limit.

Controller can compensate for reduced or increased drag. There are no limit switches to adjust.

The elevator doors' position is tracked in real-time. Adjustments to the motor speed are made while the doors are in motion through software that controls the programmable logic controller, which controls the variable speed motor driver. Real-time monitoring ensures the doors do not overshoot their mechanical limits and slam against each other on closure or slam against the sill upon opening. This eliminates wear and tear on high-maintenance parts. Further, because the doors do not slam, ambient noise is reduced.

When a forklift is loading or unloading a freight elevator, the elevator doors will bounce from their full-open position so the doors are not flush with the elevator floor. By not being fully open, the freight elevator doors damage the tires of the forklift. By monitoring the position of the doors in real-time with a string-potentiometer, the programmable logic controller can command the doors to be moved to their full-open position before the rear wheels of the forklift reach the sill.

The systems is resistant to electrical noise. An electrical spike on a power line will not affect the determination of the door and gate position. If electrical power is lost, upon power up the system will know the position of the doors and the gate because of the voltage generated from the potentiometer. No memory register has to be read and no encoder has to be reset.

The invention is not restricted to freight elevator doors. It can be used on passenger elevator doors and the size and weight of the elevator doors is irrelevant.

As various changes could be made in the above constructions and methods without departing from the scope of the invention, it is intended that all matter contained in the above description or shown in the accompanying drawings shall be interpreted as illustrative and not in a limiting sense.

What is claimed is:

1. An elevator door comprising at least one door panel operatively connected to a motor through a linkage that positions the door panel when the motor operates, the door panel motor having a control controlling motor operation, the control comprising a door panel sensor having a fixed end and a movable end that generates a signal as a relative position of the fixed and movable ends is changed, one of the door panel sensor fixed end and the movable end being directly coupled to a frame of the door panel and the other of the door panel fixed end and the movable end being directly coupled to the door panel such that the sensor senses a linear position of the door panel as the door panel is moved, the control operating the door panel motor based upon the door panel position sensed by the sensor; and further comprising a gate adjacent the door panel, the gate being operatively connected to a gate motor through a sprocket and a gate non-extendible linkage that positions the gate when the gate motor operates, the control comprising a gate sensor operatively connected to the gate motor and sensing rotary displacement of the sprocket and generating an electrical signal corresponding thereto, the control operating the gate motor to position the gate between open and closed positions based upon the gate sensor signal.

2. The elevator door of claim 1 wherein the door panel is one of an upper door panel and a lower door panel and one of the door panel sensor fixed end and the movable end is directly coupled to the lower door panel.

3. The elevator door of claim 1 wherein the control is programmable and initially operates the door panel motor at a constant speed until the door panel moves a predetermined distance sensed by the door panel sensor and then linearly decreases the speed of the door panel motor at a programmed rate until the door panel moves to one of a fully open and closed position.

4. The elevator door of claim 3 wherein the control is programmed to calculate a rate of linear decrease of the door panel motor speed based upon the door panel sensor signal.

5. The elevator door of claim 4 wherein the control is programmed to change the predetermined distance based upon a comparison of the calculated rate with the programmed rate.

6. The elevator door of claim 1 further comprising a programmable logic control that controls the gate motor and the door panel motor based upon the gate sensor signal and the door panel sensor signal.

7. The elevator door of claim 1 wherein the door panel sensor is a string potentiometer.

8. The elevator door of claim 1 wherein the control has an output signal adapted for a variable frequency drive motor.

9. The elevator door of claim 1 wherein the door panel sensor signal is analog.

10. A method comprising:

providing an elevator door motor operatively connected to an elevator door;

providing an elevator door sensor having a fixed end and a movable end that generates a signal as a relative position of the fixed and movable ends is changed;

directly coupling one of the elevator door sensor fixed end and the movable end to a frame of the door and the other of the elevator door sensor fixed end and the movable end to the door such that the sensor senses a linear position of the door as the door is moved;

inputting the elevator door sensor signal to a control for the motor;

programming the motor control to operate the elevator door motor based upon the door position sensed by the sensor; and providing a gate adjacent the door panel, the gate being operatively connected to a gate motor through a sprocket and a gate non-extendible linkage that positions the gate when the gate motor operates;

operatively connecting a gate sensor to the gate motor such that the gate sensor senses rotary displacement of the sprocket and generates an electrical signal corresponding thereto; and inputting the gate sensor signal to the motor control to operate the gate motor to position the gate between open and closed positions based upon the gate sensor signal.

11. The method of claim 10 wherein the step of providing a elevator door sensor includes providing a string potentiometer.

12. The method of claim 10 wherein the elevator door comprises an upper door panel and a lower door panel; and the step of coupling comprises directly coupling one of the elevator door sensor fixed and movable ends to the lower door panel.

13. The method of claim 10 wherein the step of programming the motor control includes programming the motor control to operate the elevator door motor at a constant speed until the door moves a predetermined distance sensed by the elevator door sensor and then linearly decreasing the speed of the elevator door motor at a programmed rate until the door moves to one of a fully open and closed position.

14. The method of claim 13 further comprising programming the motor control to calculate a rate of linear decrease of the elevator door motor speed based upon the elevator door sensor signal, comparing the calculated rate to the programmed rate, and adjusting the rate based upon a comparison of the calculated rate and the programmed rate.

15. The method claim 10 further comprising programming the motor control to generate an output for operating a variable frequency drive motor.

* * * * *